US006600259B1

(12) United States Patent
Ono et al.

(10) Patent No.: US 6,600,259 B1
(45) Date of Patent: Jul. 29, 2003

(54) FE-NI ALLOY WITH EXCELLENT MAGNETIC PROPERTIES FOR SEMI-TENSION MASK, SEMI-TENSION MASK OF THE ALLOY, AND COLOR PICTURE TUBE USING THE MASK

(75) Inventors: Toshiyuki Ono, Ibaraki (JP); Masazumi Mori, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 10/148,368

(22) PCT Filed: Aug. 14, 2000

(86) PCT No.: PCT/JP00/05446

§ 371 (c)(1),
(2), (4) Date: May 24, 2002

(87) PCT Pub. No.: WO01/38594

PCT Pub. Date: May 31, 2001

(30) Foreign Application Priority Data

Nov. 25, 1999 (JP) ..... 11-333934

(51) Int. Cl.[7] ..... C22C 38/08
(52) U.S. Cl. ..... 313/402; 148/336; 420/94
(58) Field of Search ..... 313/402; 148/336; 420/94

(56) References Cited

U.S. PATENT DOCUMENTS 6,372,058 B1 * 4/2002 Ono ..... 148/336

FOREIGN PATENT DOCUMENTS

| | | |
|---|---|---|
| JP | 7141997 A2 | 6/1995 |
| JP | 9143627 A2 | 6/1997 |
| JP | 9157799 A2 | 6/1997 |
| JP | 9310158 A2 | 12/1997 |
| JP | 9316604 A2 | 12/1997 |

* cited by examiner

*Primary Examiner*—David Vu
(74) *Attorney, Agent, or Firm*—Drinker Biddle & Reath LLP

(57) ABSTRACT

This invention provides, as a means of securing magnetic shield properties for a semi-tension mask and precluding color irregularity or mislanding on the phosphor due to beam drift, a Fe—Ni alloy for semi-tension mask comprising, in mass percentage (%), from 34 to 45% Ni, from 0.01 to 0.5% Mn, and the balance Fe and unavoidable impurities, said alloy being such that a sheet obtained after final cold rolling has an $\alpha_{(111)+(220)}$, said sum of the X-ray intensity ratio of (111) plane and (220) plane in the rolled surface represented by Formula 1

$$\alpha_{(111)+(220)} = \frac{I_{(111)} + I_{(220)}}{I_{(111)} + I_{(200)} + I_{(220)} + I_{(311)}} \times 100\ (\%)$$

of no less than 15%. The invention also provides a semi-tension mask of the alloy, and a color picture tube using the semi-tension mask.

7 Claims, 3 Drawing Sheets

FE-NI ALLOY WITH EXCELLENT MAGNETIC PROPERTIES FOR SEMI-TENSION MASK, SEMI-TENSION MASK OF THE ALLOY, AND COLOR PICTURE TUBE USING THE MASK

FIELD OF THE INVENTION

This invention relates to a semi-tension mask (also called semi-stretched-tension mask or SST mask) formed of a Fe—Ni alloy for use in a cathode-ray tube or picture tube (formerly Braun tube) and, more particularly, to a Fe—Ni alloy which has excellent magnetic properties and is outstandingly capable of controlling beam drift under the influence of geomagnetism of a mask made of it, a semi-tension mask made of the alloy, and a color picture tube using the semi-tension mask.

PRIOR ART

A picture tube is provided with a perforated mask as a mechanism through which electron beams from electron guns precisely strike the intended color phosphor dot on a phosphor screen to give a desired color tone. Masks for picture tubes are roughly divided into two types; shadow mask type or a mask workpiece formed with dots or slots for the passage of electron beams by etching and then formed to the mask shape by pressing, and aperture grille type or a mask workpiece formed with elongated slits for the passage of electron beams by etching and then pulled vertically and tentered or stretched on a frame.

For the shadow mask type, Fe-36% Ni alloy (invar) is commonly used as it controls the doming phenomenon that results from thermal expansion. For the aperture grille type whose structural features rarely allow doming due to thermal expansion, mild steel that is higher in the coefficient of thermal expansion but is less expensive is employed.

With both advantages and disadvantages the two types have dominated the market. More recently, what is known as semi-tension mask has come on the scene as a new type combining the merits of the former two.

The semi-tension mask is made by vertically stretching a mask workpiece that has been formed with dots or slots for the passage of electron beams by etching and supporting it on a frame (tentering) rather than pressing the sheet, as in the aperture grille type. In the early stage of its development, the mask needed its workpiece be stretched not only vertically but also horizontally, i.e., in a total of four directions. The four-direction stretching sometimes broke the mask workpieces. To preclude this danger, experiments were made on stretching the workpieces only in two vertical directions and favorable results were obtained. The mask made by the improved method of stretching the workpiece with weak forces in two directions, rather than in four directions, is designated semi-stretched tension mask, or briefly semi-tension mask.

FIGS. 1 and 2 are schematic views illustrating, respectively, a semi-tension type mask and an aperture grille type mask. Both masks are stretched vertically, or upwardly and downwardly. In a semi-tension mask a multiplicity of columns of vertical slots are formed from edge to edge. Each column of slots comprises a number of slots separated by bridges formed between the ends of adjacent slots. An aperture grille mask, by contrast, has a multiplicity of long vertical slits extending from nearly top to nearly bottom and arranged sidewise from edge to edge. It requires damper wires to control the vibration of the mask that is caused by sound sources such as speakers. The bridges of a semi-tension mask are the portions left unetched when the slots have been formed by etching. They serve to prevent the columns of vertical slots from being twisted. Because of the presence of bridges in the individual columns of slots, the mask is also called a bridged tension mask.

Compared with the shadow mask type formed by press work, the semi-tension mask type permits the picture tube to be more flattened with greater brightness and higher resolution. Moreover, the presence of bridges enables the semi-tension type to be superior to the aperture grille type in vibration resistance, with no necessity of damper wire. Further, the former requires relatively low loads for vertical stretching, which helps reduce the cost.

On the other hand, the semi-tension mask type has the possibility of doming with thermal expansion due to the low stretching force and bridging, as compared with the aperture grille type. To prevent the phenomenon, the use of Fe—Ni alloys of low thermal expansion, especially invar, is under study. It has, however, been found that the use of invar that has hitherto been used for superfine color display in the manufacture of a semi-tension mask causes a problem of serious beam drift along edges of the mask. Ordinarily a semi-tension mask is made substantially flat for flat picture tubes (center height of the curved screen/diagonal length of the screen <0.1%). Thus at the edges of the mask the angle that a beam makes with the mask is small at the edges, with the consequence that a slight beam drift of an electron beam from an electron gun results in an increased amount of mislanding on the phosphor. One of the intended features of a semi-tension mask is to obtain high luminance by increasing the aperture ratio. This sacrifices the magnetic shield characteristic of the mask itself to such an extent that beam drift is likely to take place.

Another problem is wrinkling of the mask. In the manufacture of a semi-tension mask a workpiece formed with dots or slots by etching is blackened, welded to a frame, and stretched under predetermined loads. Here the term "blacken" is used to mean a treatment in which a mask workpiece is heated in a steam or combustion gas atmosphere to form a black film such as an iron oxide film on the surface so that the mask looks black. The blackened work is stretched under given loads, welded to a frame, and baked to be freed of strains that have resulted from welding and other operation. It has recently been found that, during the baking, the invar sheet under tension by the frame undergoes plastic deformation at elevated temperature, or creeping. Once it occurs, creeping causes elongation of the mask and the "tension down" or relief of loads which, in turn, lead to wrinkling, deterioration of vibration characteristics, and various other problems. Thus the drawbacks of the semi-tension mask type include the tension down upon baking in the course of the fabrication, leading to wrinkling and other major troubles.

PROBLEMS THAT THE INVENTION IS TO SOLVE

From the viewpoint of thermal expansion, mild steel and the like are not suited as materials for semi-tension mask, and it has been necessary to use a low-thermal-expansion alloy such as invar, with improved magnetic shield characteristic. When used in the manufacture of a semi-tension mask, the invar that is used for a shadow mask of the pressed type with no magnetic shield problem, deteriorates the magnetic shield characteristic of the semi-tension mask. Careful investigation of the manufacturing steps has revealed that this difference is caused by a significant change in the magnetic characteristic of the material with stretching, i.e., before and after the stretching.

To be more concrete, it is necessary with the pressed type shadow mask to allow its bridges (the portions between the apertures in the form of dots or slots through which electron beams pass) to have sufficient (self-shape-retaining) strength to keep its shape (curvature). In order to attain high luminance, the etching factor (amount of etching in the depth direction/amount of side etching) should be high so as to form a multiplicity of dots or slots by etching while securing the bridges, and for that purpose it is customary to treat the workpiece in such a manner as to avoid the collection in the rolled surface of the closest packed (111) plane where the corrosion rate is low. We tentered the material on a frame, stretching it in the rolling direction (the <100>direction) and in the directions (<110> directions) at angles of 90° and 45° to the rolling direction, and these magnetic properties were determined. With a geomagnetic shield after AC demagnetization as in a picture tube, the higher the residual magnetic flux density (Br) and the smaller the coercive force (Hc), the better the magnetic shield properties. Hence the magnetic shield properties are improved as the relative magnetic permeability calculated as Br/Hc, $\mu_{Br/Hc}$, increases. It has been found that a sheet tentered both in the rolling direction and in the transverse direction to the rolling direction showed less relative magnetic permeability $\mu_{Br/Hc}$ than when not tentered and exhibited inferior magnetic shield properties, whereas a sheet stretched in the direction at an angle of 45° to the rolling direction gave greater relative magnetic permeability $\mu_{Br/Hc}$ and better magnetic shield properties. It has also been found that the relative magnetic permeability $\mu_{Br/Hc}$ varies with the blackening temperature and the stresses applied for stretching. However, working a mask blank from a strip obliquely at an angle of 45° is not practicable because of much material loss it involves.

The present invention is aimed at introducing measures whereby favorable magnetic shield properties of a semi-tension mask are secured and color irregularity or mislanding due to beam drift can be prevented. Another aim of the invention is to improve the creep properties of a semi-tension mask in view of the fact that when ordinary invar is used for a semi-tension mask, baking in the course of mask fabrication causes tension-down of the material, leading to wrinkling and other serious problems.

MEANS OF SOLVING THE PROBLEMS

It has now been found possible to secure magnetic shield properties and preclude color irregularity or mislanding on the phosphor due to beam drift by controlling the sum of the X-ray intensity ratio of (111) plane and (220) plane in the rolled surface of a Fe—Ni alloy. It has also been found that the sum of the X-ray intensity ratio of (111) plane and (220) plane can be controlled according to the blackening temperature of the semi-tension mask and the stresses of stretching the mask. It has further been found that the creep properties of a Fe—Ni alloy can be improved without wrinkling and other troubles in the course of blackening, stretching, and baking for the manufacture of a semi-tension mask by choosing proper proportions of Al and Si and restricting the proportions of impurities C, P, and S in the alloy, and performing stress relief annealing of the alloy.

On the basis of the above discoveries, the present invention solves the problems of the prior art by providing:

(1) A Fe—Ni alloy for semi-tension mask comprising from 34 to 45% Ni, from 0.01 to 0.5% Mn, and the balance Fe and unavoidable impurities, said alloy being such that a sheet obtained after final cold rolling has $\alpha_{(111)+(220)}$, said sum of the X-ray intensity ratio of (111) plane and (220) plane in the rolled surface represented by Formula 1

$$\alpha_{(111)+(220)} = \frac{I_{(111)} + I_{(220)}}{I_{(111)} + I_{(200)} + I_{(220)} + I_{(311)}} \times 100\ (\%) \quad (1)$$

of no less than 15%;

(2) A Fe—Ni alloy according to (1) wherein, assuming that the temperature for blackening the mask is T° C. and the stress for stretching it as a semi-tension mask is σN/mm$^2$, the $\alpha_{(111)+(220)}$ in the sheet surface after the final cold rolling satisfies Formula 2

$$-0.28T-0.1\sigma+218 \leqq \alpha_{(111)+(220)} \leqq 55(\%); \quad (2)$$

(3) A low thermal-expansion Fe—Ni alloy according to (1) or (2) which further comprises from 0.005 to 0.20% Si and from 0.005 to 0.030% Al;

(4) A Fe—Ni alloy according to (1), (2), or (3) wherein, out of the unavoidable impurities, C accounts for no more than 0.010%, P for no more than 0.015%, and S for no more than 0.010%;

(5) A Fe—Ni alloy according to any of (1) to (4) which is subjected to stress relief annealing after the final cold rolling.

The present invention also provides:

(6) A semi-tension mask made from the Fe—Ni alloy according to any of (1) to (5) by the steps of forming dots or slots for the passage of electron beams by etching in a mask workpiece of the Fe—Ni alloy, blackening, stretching the blackened workpiece in two directions or upwardly and downwardly, and then stretching the same on a frame; and (7) A color picture tube using the semi-tension mask according to (6).

OPERATION OF THE INVENTION

As explained above, FIG. 1 schematically illustrates a semi-tension type mask. The mask is tentered on a frame as stretched vertically, or upwardly and downwardly. In the semi-tension mask a multiplicity of columns of vertical slots are formed over the entire width. Each slot column has a number of slots separated from one another by a bridge defined between the ends of adjacent slots. The bridges in a semi-tension mask constitute unetched portions between slots in the columns left after the slots have been formed by etching. They serve to prevent twisting of the columns of vertical slots. Compared with the shadow mask formed by pressing, the semi-tension mask can be more precisely flattened with higher brightness and higher resolution. In addition, the semi-tension mask is superior in vibration characteristics to the aperture grille type. It requires no damper wire and less loads for stretching it in two vertical directions, both of which contribute to the reduction of the manufacturing cost.

The semi-tension mask according to the present invention uses a Fe—Ni alloy comprising from 34 to 45% Ni, from 0.01 to 0.5% Mn, desirably from 0.005 to 0.20% Si and from 0.005 to 0.030% Al, and the balance Fe and unavoidable impurities, in which preferably C is limited to no more than 0.010%, P to no more than 0.015%, and S to no more than 0.010%.

The semi-tension mask of the invention is manufactured in the following way. A Fe—Ni alloy of a predetermined composition is melted in a vacuum melting furnace, and the ingot so obtained is forged and hot rolled to a thickness from 2 to 4 mm. It is then repeatedly cold rolled and bright annealed to form a cold rolled sheet from about 0.3 mm to about 0.11 mm thick. Following recrystallization annealing, it is finally cold rolled to a thickness of 0.1 mm±0.05 mm as a mask material. Preferably, the final cold rolling is followed by a stress relief annealing at 350 to 500° C. for from 10 minutes to one hour. The mask sheet is then degreased and coated with a photoresist on both sides, exposed to light for patterning. After developing, the surface is sprayed with an etching solution consisting essentially of aqueous ferric chloride to form dots or slots by etching. The etched sheet is blackened in a steam or combustion gas atmosphere at 580 to 670° C., stretched both upwardly and downwardly, and welded in a tentered state to a frame, whereby a semi-tension mask is made. Lastly, the mask is baked at 350 to 500° C. for from 10 minutes to one hour to remove strains that have resulted from welding and other operations.

The greatest feature that characterizes the present invention is that magnetic shield properties are secured and color irregularity or mislanding on the phosphor due to beam drift is suppressed by controlling the sum of the X-ray intensity ratio of (111) plane and (220) plane in the rolled surface of a Fe—Ni alloy.

We made mask blanks from an invar strip of Fe—Ni alloy for pressed masks having a (111) plane X-ray intensity ratio of less than 1%, by etching the blanks so that the longitudinal direction of their grids were at intervals of 5° in the range from 0 to 45° to the rolling direction, blackening the masks at 640° C., and stretching them under a load of 100 $N/mm^2$, and then examined the amounts of drift of the beam that passed the grids. In the meantime, test specimens were cut off in rectangles at angles from 0 to 45° to the rolling direction. They were stretched at 100 $N/mm^2$, their hysteresis loops at the maximum magnetic field of 3183 A/m, and their relative magnetic permeability $\mu_{Br/Hc}$ values were computed. It was then confirmed that the beam drift can be suppressed to a satisfactory level if the relative magnetic permeability $\mu_{Br/Hc}$ is 2400 or more.

It was also confirmed that magnetic shield properties can be secured by changing the sum of the X-ray intensity ratio of (111) plane and (220) plane in the rolled surface as well as by changing the angle of sampling from a strip having a (111) plane X-ray intensity ratio of less than 1%.

In brief, we have found that magnetic shield properties can be secured and color irregularity or mislanding on the phosphor due to beam drift be precluded by controlling the sum of the X-ray intensity ratio of (111) plane and (220) plane in the rolled surface of a Fe—Ni alloy. The sum of the X-ray intensity ratio of (111) plane and (220) plane can be controlled according to the blackening temperature of the semi-tension mask and the stresses of stretching the mask.

In the manufacture of a semi-tension mask a workpiece formed with dots or slots by etching is blackened, welded to a frame, and stretched under predetermined loads. The blackened work is baked to be freed of strains that have resulted from welding and other operation. During the baking, the invar sheet under tension by the frame undergoes plastic deformation at elevated temperature, or creeping. Once it occurs, creeping causes elongation of the mask and the "tension down" or relief of loads which, in turn, lead to wrinkling, deterioration of vibration characteristics, and various other problems. The present invention improves the mask in respect of the creeping.

The grounds on which various limitations are placed under the invention will now be explained.

Ni:—A Ni content less than or more than 36% increases the coefficient of thermal expansion and deteriorates the color purity of the resulting mask. If the Ni content is below 34% the thermal expansion coefficient rises rapidly, the softening temperature declines, the proof stress after blackening decreases, and the creep elongation upon tentering tends to increase. For these reasons the lower limit of Ni is 34%.

If the Ni content is more than 36%, the thermal expansion coefficient of the alloy increases but the softening temperature rises too, limiting the drop of proof stress after blackening, and increasing the stretching forces to prevent the deterioration of its doming tendency due to thermal expansion. Moreover, the larger the Ni content the better the magnetic properties of the alloy. However, if the Ni content exceeds 45%, the alloy is little different from mild steel in respect of thermal expansion and economically there is no merit of employing the Fe—Ni alloy for a semi-tension mask. Hence the Ni content is specified to be between 34 and 45%.

Mn:—Mn is needed because it makes S, an impurity that hampers hot workability, harmless. In a proportion below 0.01% it no longer achieves the favorable effect and, above 0.5%, it deteriorates the etching properties and raises the coefficient of thermal expansion. For these reasons the Mn proportion is limited to the range between 0.01 and 0.5%. A preferred range for the improvements of etching and thermal expansion properties is between 0.01 and 0.1%.

Si:—Si is added as a deoxidant. Since a large Si content seriously affects etchability, a small content is desirable. Even in a small amount, Si is effective in improving creep properties, and therefore the range is between 0.005 and 0.20%. For better etching properties a range from 0.03% downward is preferred.

Al:—Al is utilized as a deoxidant, and a solid solution containing much Al proves effective in improving creep properties. However, a large Al content forms alumina to impair the etchability or produces alumina-derived surface flaws on cold rolling. The range, therefore, is between 0.005 and 0.030%.

C:—C form a carbide, but more than 0.010% C forms the carbide to excess, impairing etchability. For this reason 0.010% is the upper limit. C in a solid solution too affects the etchability adversely, and the smaller the C content the better. A preferred C proportion is below 0.005%.

P:—Excessive P causes inferior etching. The P content should be kept below 0.015%.

S:—S in excess of 0.010% has a detrimental effect upon hot workability, while forming much sulfide inclusions which, in turn, impairs etchability. Hence the upper limit of 0.010%.

$\alpha_{(111)+(220)}$, said sum of the X-ray intensity ratio of (111) plane and (220) plane in the rolled surface: The $\alpha_{(111)+(220)}$ materially influences the magnetic properties of the mask material when stretched in the directions parallel to the rolling direction and transverse to the rolling direction. When the $\alpha_{(111)+(220)}$, is small, the relative magnetic permeability of the mask material upon stretching is low and the magnetic shield properties are unfavorably affected. To secure proper magnetic shield properties, the $\alpha_{(111)+(220)}$ should be at least 15%.

Here the $\alpha_{(111)+(220)}$ is a value calculated by Formula 1, which is defined as:

$$\alpha_{(111)+(220)} = \frac{I_{(111)} + I_{(220)}}{I_{(111)} + I_{(200)} + I_{(220)} + I_{(311)}} \times 100\ (\%) \quad (1)$$

In order to increase the $\alpha_{(111)+(220)}$ it is necessary to restrict the reduction ratio of cold rolling. Since it involves an increase in the frequency of annealing, extra cost is required. Also, the $\alpha_{(111)+(220)}$ being the same, the relative magnetic permeability would be increased if the temperature for blackening the mask were high. The $\alpha_{(111)+(220)}$, therefore, desirably falls within the range of Formula 2 that is obtained experimentally from the relation between the blackening temperature T° C. and the stress of stretching óN/mm$^2$:

$$-0.28T-0.1\sigma+218 \leqq \alpha_{(111)+(220)} \leqq 55(\%) \quad (2)$$

Formulas 1 and 2 will now be explained.

A Fe—Ni alloy consisting of 36.1% Ni, 0.25% Mn, and the balance iron and unavoidable impurities was refined by vacuum melting and the ingot was hot forged and hot rolled to a sheet 3 mm thick and then was descaled by pickling. Next, to vary the $\alpha_{(111)+(220)}$, said sum of the X-ray intensity ratio of (111) plane and (220) plane, test sheets were annealed once or twice and cold rolled at several different reduction ratios to a thickness of 0.13 mm. These materials were annealed for recrystallization and then cold rolled to a thickness of 0.1 mm. The crystal orientations of their rolled surfaces were determined by X-ray diffraction analysis and the $\alpha_{(111)+(220)}$ values were found. The test materials were blackened at different temperatures of 580, 600, and 640° C. for 15 minutes, and were subjected to tensile stresses of 100, 150, and 200 N/mm$^2$ in the direction parallel to the rolling direction. From hysteresis loops in the maximum magnetic field of 3183 A/m, their relative magnetic permeability $\mu_{Br/Hc}$ values were determined.

FIGS. 3 to 5 show the relations between the $\alpha_{(111)+(220)}$ of the rolled surface after final cold rolling and the relative magnetic permeability $\mu_{Br/Hc}$, with different tensile stresses and blackening temperatures. Of the combinations of the tensile stresses and blackening temperatures, the $\alpha_{(111)+(220)}$ values of the rolled surfaces after final cold rolling at the relative magnetic permeability $\mu_{Br/Hc}$ of 2400 that was judged to cause no beam drifting were found, as given in Table 1. It will be obvious from the table that the $\alpha_{(111)+(220)}$ at a blackening temperature below 640° C. (above which and closer to the softening temperature the strength decreases) and a stretching stress below 200 N/mm$^2$ (above which and closer to the proof stress the creep elongation increases) is desirably above 15%. On the basis of the results given in Table 1, the left-hand side member of Formula 2 was obtained by finding an approximate expression of the $\alpha_{(111)+(220)}$ at which the relative magnetic permeability $\mu_{Br/Hc}$ was 2400 or more, using the two variables blackening temperature T C and tensile stress óN/mm$^2$.

Table 1. The $\alpha_{(111)+(220)}$ values of the finally cold rolled surfaces where the relative magnetic permeability $\mu_{Br/Hc}$ was 2400 at varied blackening temperatures and tensile stresses

| Blackening | The $\alpha_{(111)+(220)}$ values (%) where the relative magnetic permeability $\mu_{Br/Hc}$ was 2400 Tensile stress (óN/mm$^2$) | | |
|---|---|---|---|
| temp. T (° C.) | 100 | 150 | 200 |
| 580 | 45.0 | 38.8 | 33.2 |
| 600 | 38.4 | 32.6 | 26.7 |
| 640 | 27.9 | 21.8 | 16.0 |

If the $\alpha_{(111)+(220)}$ value of a finally cold rolled surface is to be small, the reduction ratio of the cold rolling before the final annealing should be low. When the reduction ratio is low the subsequent recrystallization annealing brings a duplex grain structure. The upper limit of the $\alpha_{(111)+(220)}$ value of the finally cold rolled surface made at the limit of reduction ratio just short of a duplex grain structure was 55%. This gave the right-hand side member of Formula 2, and eventually Formula 2 was determined.

Lastly, the final cold rolling reduction ratio and stress relief annealing will be explained.

Final cold rolling reduction ratio:—When the ratio of reduction by final cold rolling is less than 15%, improvement of strength by the work hardening is small and the creep-improving effect is not quite appreciable. On the other hand, when the reduction ratio is more than 60%, the material begins to soften during blackening treatment which, in turn, affects the high-temperature strength and creep properties unfavorably. Hence the final cold rolling reduction ratio desirably is between 15 and 60%. When the blackening temperature exceeds 600° C., it is desirable that the final cold rolling reduction ratio be between 20 and 40%.

Stress relief annealing:—Although it has no effect upon creep elongation of the work after blackening, the annealing of this character is desirable since it controls uneven deformation due to release of the residual stresses during blackening. Stress relief annealing at 350 to 500° C. for from 10 minutes to one hour after final cold rolling is recommended.

WORKING EXAMPLES

The invention will be more fully described below.

Fe—Ni alloys of the compositions shown in Table 2 were melt-refined and the ingots were hot forged and hot rolled to 3 mm thickness, and the sheets so obtained were descaled by pickling.

TABLE 2

| Comp No. | C | Si | Mn | P | S | Ni | Al | Remarks |
|---|---|---|---|---|---|---|---|---|
| A | 0.004 | 0.02 | 0.28 | 0.004 | 0.003 | 36.2 | 0.012 | Conforming |
| B | 0.005 | 0.01 | 0.25 | 0.004 | 0.002 | 36.0 | 0.022 | to claims |
| C | 0.003 | 0.02 | 0.25 | 0.004 | 0.003 | 36.0 | 0.022 | 1–4 |
| D | 0.012 | 0.01 | 0.26 | 0.003 | 0.002 | 35.8 | 0.015 | Conforming |
| E | 0.003 | 0.02 | 0.26 | 0.018 | 0.002 | 36.2 | 0.014 | to claims |
| F | 0.004 | 0.03 | 0.24 | 0.002 | 0.013 | 35.7 | 0.011 | 1–3 |
| G | 0.003 | 0.23 | 0.26 | 0.003 | 0.002 | 36.1 | 0.018 | Conforming |
| H | 0.003 | 0.003 | 0.25 | 0.004 | 0.003 | 36.0 | 0.016 | to claim 1 |
| I | 0.006 | 0.02 | 0.27 | 0.002 | 0.003 | 35.8 | 0.042 | |
| J | 0.007 | 0.01 | 0.25 | 0.004 | 0.002 | 35.9 | 0.003 | |
| K | 0.004 | 0.02 | 0.85 | 0.003 | 0.002 | 36.1 | 0.017 | Not |
| L | 0.005 | 0.02 | 0.007 | 0.002 | 0.002 | 35.7 | 0.021 | conforming |
| M | 0.003 | 0.02 | 0.27 | 0.003 | 0.002 | 46.3 | 0.014 | to claim 1 |
| N | 0.005 | 0.01 | 0.26 | 0.002 | 0.002 | 33.1 | 0.018 | |

In order to vary the $\alpha_{(111)+(220)}$, test sheets were annealed once or twice and rolled at several different reduction ratios to a thickness of 0.13 mm. These materials were annealed for recrystallization and then cold rolled to a thickness of 0.1 mm. The crystal orientations of the rolled surfaces were determined by X-ray diffraction analysis and the $\alpha_{(111)+(220)}$ values were found. The test materials were blackened at 640° C. for 15 minutes, subjected to a tensile stress of 100 N/mm$^2$, and, in an AC magnetic field of 3183 A/m, their relative magnetic permeability $\mu_{Br/Hc}$ values were determined. Other test materials were subjected to a tensile stress of 100 N/mm$^2$ while being heated at 460° C., and the creep elongation percentages one hour later were measured. The tensile direction was parallel to the rolling direction.

Table 3 shows the test materials and their values of the $\alpha_{(111)+(220)}$, said sum of the X-ray intensity ratio of (111) plane and (220) plane in the rolled surface after final cold rolling, relative magnetic permeability $\mu_{Br/Hc}$, creep elongation, mean thermal expansion coefficient in the range of 30–100° C., and as a measure of etchability, the appearance of the etched surface after spraying of the surface at 60° C. with a 45 Baumé aqueous solution of ferric chloride at a pressure of 0.3 MPa.

Nos. 10 to 13, with relative magnetic permeability $\mu_{Br/Hc}$ in excess of 2400, were comparable to Nos. 1 to 6 in creep elongation. However, the etched surfaces showed minute unevenness or irregularities. Presumably responsible for the irregularities were the presence of iron carbide in No. 10, manganese sulfide (MnS) in No. 11, silicon dioxide ($SiO_2$) in No. 12, and alumina ($Al_2O_3$) in No. 13.

These irregularities vary with etching conditions (e.g., the specific gravity and temperature of the etching solution). Certain conditions can impair the etched surface appearance.

No. 14, which contained Mn beyond the specified range (0.01–0.5%), left many etch pits of MnS marks on the etched surface. MnS is ductile and is spread on rolling. Many such marks are present on the walls of beam apertures in the form of slots or dots, deteriorating their configurations. On the other hand, No. 15 contained Mn in a less than specified proportion or not large enough to makes S, an impurity that hampers hot workability, harmless. Thus it can hardly be manufactured industrially because it develops many cracks and spills during hot rolling.

Nos. 16 and 17 whose Ni contents were outside the specified range (34–45%) possessed too high thermal expansion coefficients for semi-tension mask materials. Moreover, No. 17 exhibited excessive creep elongation because of its low Ni content.

TABLE 3

| No. | Comp. | $\alpha_{(111)-(220)}$ (%) after final cold rolling | Relative magnetic permeablty, $\mu_{Br/Hc}$ | 450° C.-1 hr creep elong (%) blackened at 640° C. under 100 N/mm$^2$ | 30–100° C. mean therm coeff $\times 10^{-7}$/° C. | Condition of etched surface | Relation with the range ($29 \leqq \alpha_{(111)+(220)} \leqq 55$ calculated by Formula 2 at T = 640° C., σ = 100 N/mm$^2$ |
|---|---|---|---|---|---|---|---|
| 1 | A | 47 | 3488 | 0.064 | 12 | Good | Satisfies |
| 2 | A | 35 | 2792 | 0.057 | — | — | Satisfies |
| 3 | B | 52 | 3742 | 0.061 | 24 | Good | Satisfies |
| 4 | B | 34 | 2852 | 0.055 | — | — | Satisfies |
| 5 | C | 49 | 4152 | 0.057 | 33 | Good | Satisfies |
| 6 | C | 36 | 3452 | 0.053 | — | — | Satisfies |
| 7 | A | 58 | 4103 | 0.087 | — | — | Does not |
| 8 | C | 57 | 4456 | 0.078 | — | — | Does not |
| 9 | H | 59 | 4169 | 0.092 | 11 | Good | Does not |
| 10 | D | 32 | 2620 | 0.061 | 13 | Fair* | Satisfies |
| 11 | F | 35 | 2792 | 0.058 | 13 | Fair* | Satisfies |
| 12 | G | 32 | 2576 | 0.061 | 14 | Fair* | Satisfies |
| 13 | I | 34 | 2528 | 0.058 | 13 | Fair* | Satisfies |
| 14 | K | 32 | 2573 | 0.065 | 19 | Fair* | Satisfies |
| 15 | L | 37 | 2915 | 0.062 | 10 | Good | Satisfies |
| 16 | M | 31 | 3104 | 0.048 | 57 | Good | Satisfies |
| 17 | N | 35 | 2706 | 0.112 | 55 | Good | Satisfies |
| 18 | A | 1 | 637 | 0.065 | — | — | Does not |
| 19 | B | 12 | 1592 | 0.061 | — | — | Does not |
| 20 | E | 12 | 1472 | 0.062 | 12 | Fair* | Does not |
| 21 | J | <1 | 716 | 0.081 | 12 | Good | Does not |

*Minute irregularities and etched marks with impurities.

Nos. 1 to 6 represent examples of the invention meeting the requirements of claims 1 to 4 (composition and Formulas 1 and 2). They exhibited excellent magnetic shield properties with relative magnetic permeability $\mu_{Br/Hc}$ values in excess of 2400 that is enough to suppress beam drifting. Their creep elongation values were less than 0.07% and the etched surface conditions were good. Their thermal expansion coefficients increased in proportion to their Ni contents, but the deterioration of the doming properties could be prevented by adjusting the stretching forces.

Nos. 7 to 9 had favorable relative magnetic permeability $\mu_{Br/Hc}$ above 4000 but their creep elongation values were more than those of Nos. 1 to 6 because their $\alpha_{(111)+(220)}$ values of the finally cold rolled surface were more than the limit of 55% specified by Formula 2. Thus the use of greater stretching forces could cause wrinkling of the resulting semi-tension masks.

Nos. 18 to 21 whose $\alpha_{(111)+(220)}$ percentages were less than the values specified by Formula 2 indicated insufficient magnetic shield properties with relative magnetic permeability $\mu_{Br/Hc}$ values below 2400. No. 20 retained traces of etching apparently as an effect of phosphorus segregation in the etched surface. Depending on the etching conditions the surface unevenness or irregularities can have adverse effects upon scattering of the beams that pass through the surface apertures.

In the working examples of the invention thus far described, the final cold rolling was not followed by stress relief annealing. It was confirmed, however, that stress relieving only negligibly changes the $\alpha_{(111)+(220)}$ and therefore brings practically no change in the magnetic properties.

It should be noted, however, that when no stress relief annealing is done in the manner described the residual stress distribution in the sheet formed to a mask with dots or slots by etching is sometimes out of balance and the stresses released by blackening treatment can deteriorate the shape of the product. Thus, in the stretching operation it is desirable that stress relieving be conducted lest blackening should impair the mask configuration. Where necessary, correction of the shape by a tension leveler or other means may be done. It is to be understood, of course, that the addition of such process step does not affect the validity of the present invention but falls within the purview of the invention as set forth in the appended claims.

EFFECTS OF THE INVENTION

The Fe—Ni alloy according to the present invention, with excellent magnetic properties, is a suitable material for color picture tubes free of color irregularity due to beam drift. In particular the semi-tension mask according to the invention desirably permits flattening of the screen of a color picture tube.

Figure 1:
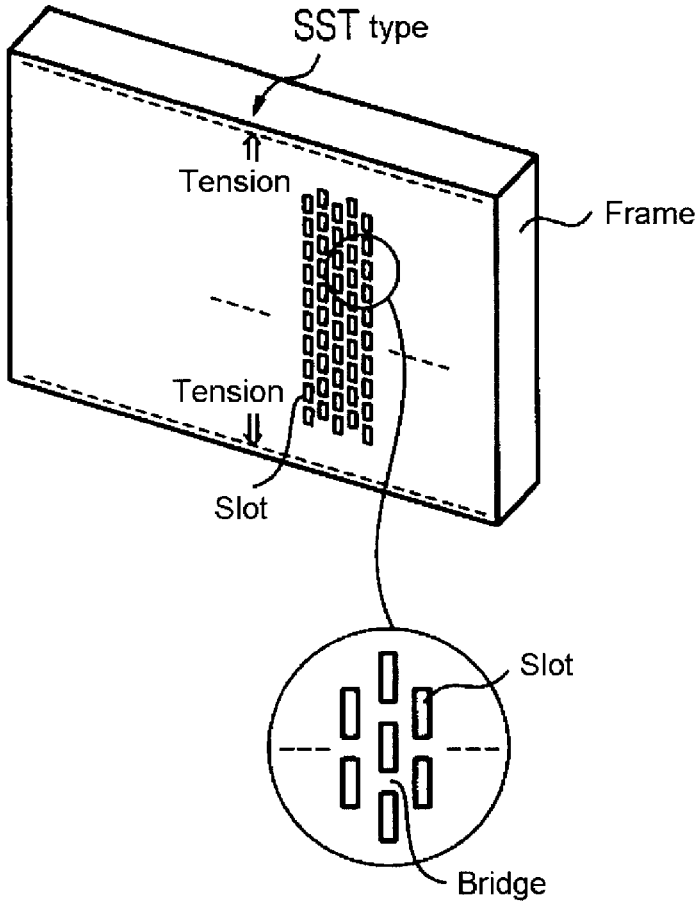
FIG. 1 is a schematic perspective view of a mask of the semi-tension type.
Figure 2:
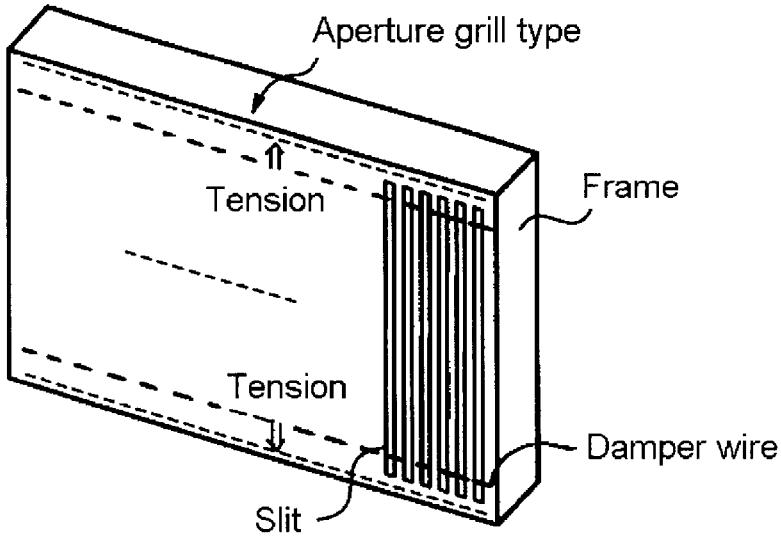
FIG. 2 is a schematic perspective view of a mask of the aperture grille type.
Figure 3:
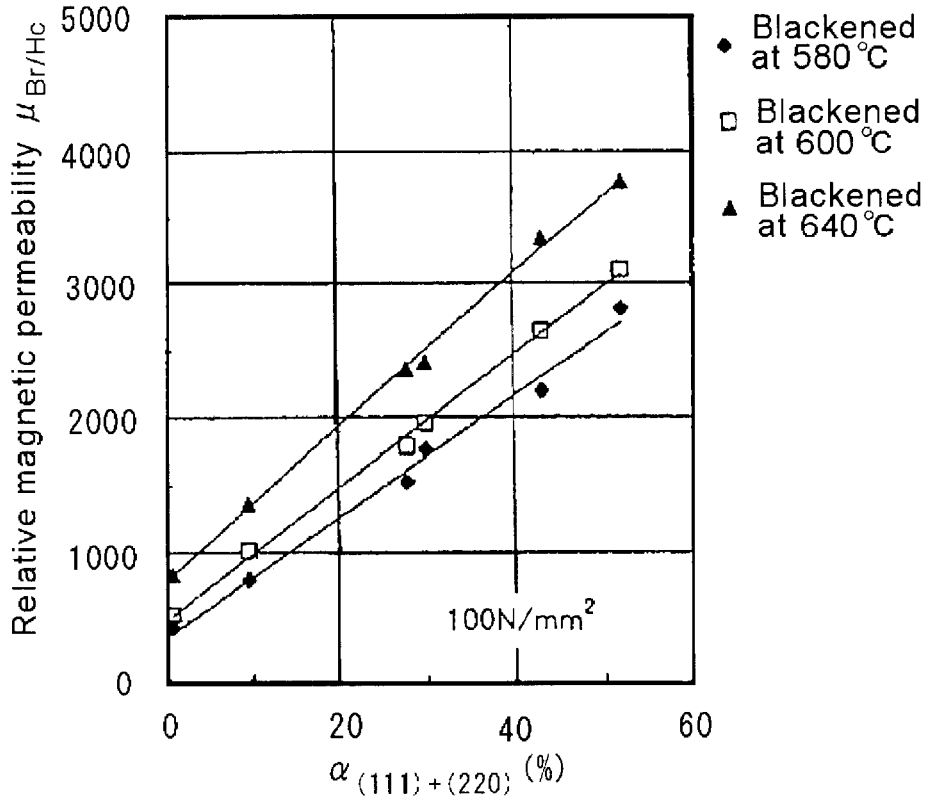
FIG. 3 is a graph showing the relationship between the $\alpha_{(111)+(220)}$ and the relative magnetic permeability of specimens after blackening under a load of tensile stress of 100 $N/mm^2$.
Figure 4:
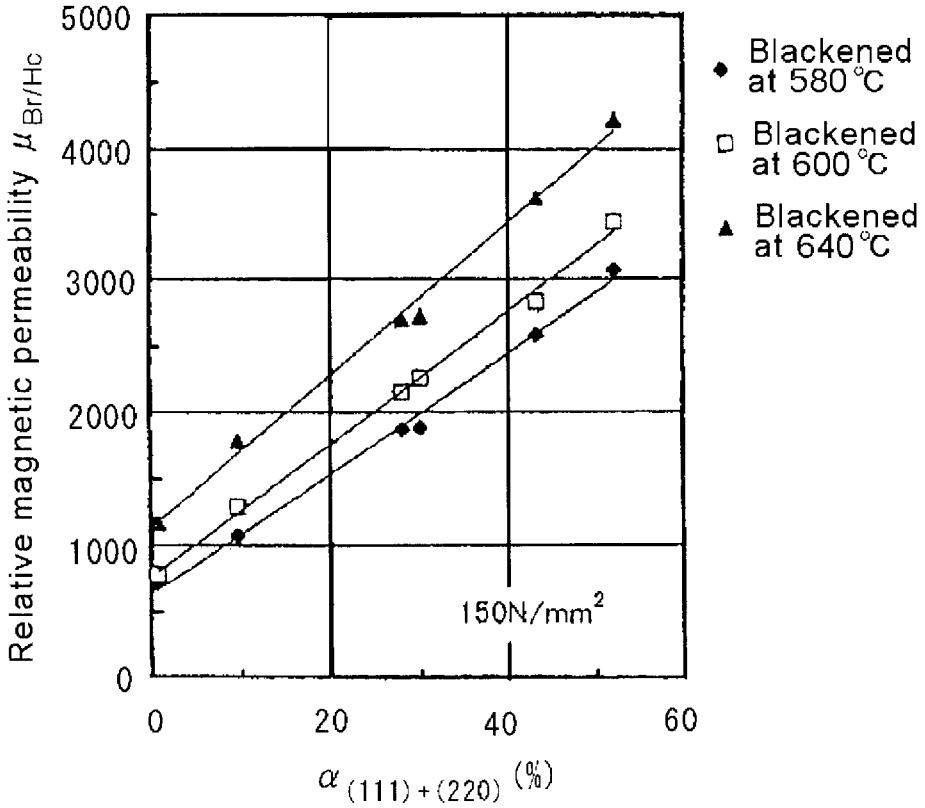
FIG. 4 is a graph showing the relationship between the $\alpha_{(111)+(220)}$ and the relative magnetic permeability of specimens after blackening under a load of tensile stress of 150 $N/mm^2$.
Figure 5:
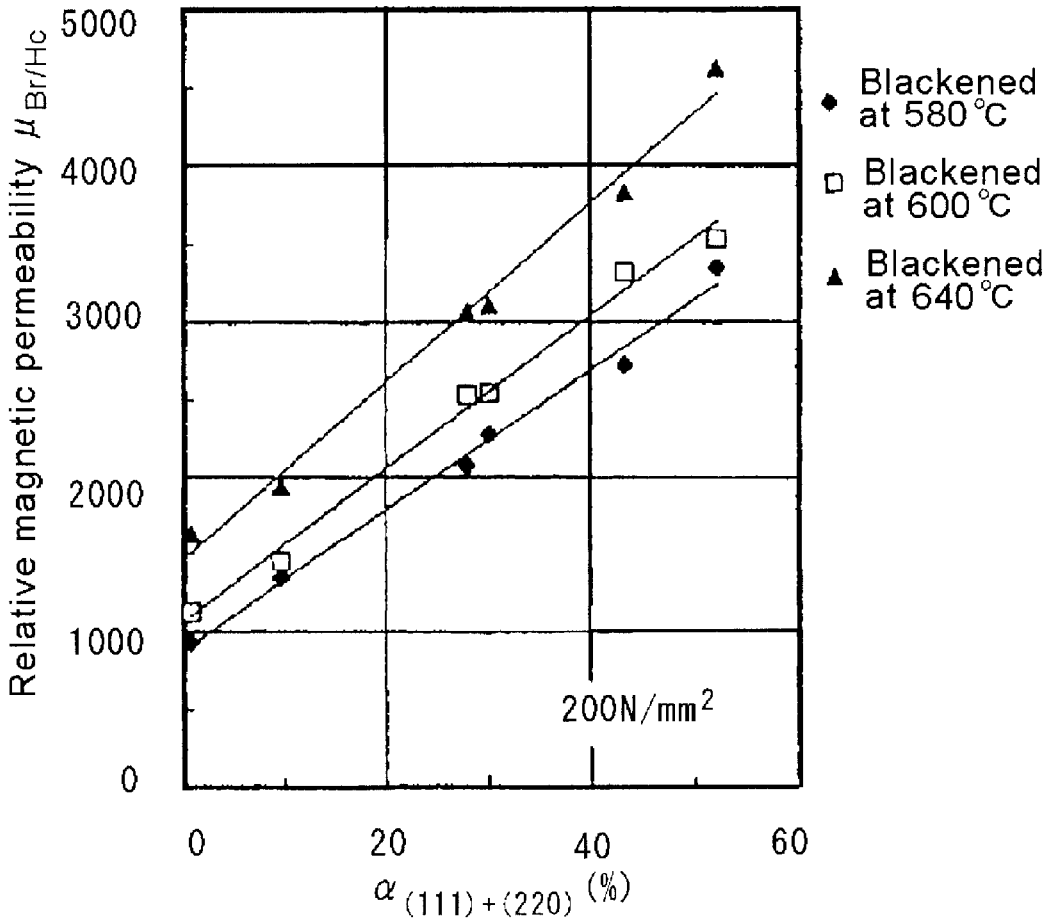
FIG. 5 is a graph showing the relationship between the $\alpha_{(111)+(220)}$ and the relative magnetic permeability of specimens after blackening under a load of tensile stress of 200 $N/mm^2$.

What is claimed is:

1. A Fe—Ni alloy for semi-tension mask comprising, in mass percentage (%), from 34 to 45% Ni, from 0.01 to 0.5% Mn, and the balance Fe and unavoidable impurities, said alloy being such that a sheet thereof obtained after final cold rolling of said alloy has an $\alpha_{(111)+(220)}$, which is the sum of the X-ray intensity ratio of the (111) plane and the (220) plane in the sheet rolled surface, represented by Formula 1

$$\alpha_{(111)+(220)} = \frac{I_{(111)} + I_{(220)}}{I_{(111)} + I_{(200)} + I_{(220)} + I_{(311)}} \times 100\ (\%) \quad (1)$$

of no less than 15%.

2. A Fe—Ni alloy according to claim 1 wherein, assuming that the temperature for blackening the mask is T° C. and the stress for stretching it as a semi-tension mask is ó$N/mm^2$, the $\alpha_{(111)+(220)}$ in the sheet surface after the final cold rolling satisfies Formula 2

$$-0.28T-0.1\sigma+218 \leqq \alpha_{(111)+(220)} \leqq 55(\%) \quad (2).$$

3. A Fe—Ni alloy according to claim 1 which further comprises from 0.005 to 0.20% Si and from 0.005 to 0.030% Al.

4. A Fe—Ni alloy according to claim 1 wherein, out of the unavoidable impurities, C accounts for no more than 0.010%, P for no more than 0.015%, and S for no more than 0.010%.

5. A Fe—Ni alloy according to claim 1 which is subjected to stress relief annealing after the final cold rolling.

6. A semi-tension made from the Fe—Ni alloy according to claim 1 by the steps of etching dots or slots for the passage of electron beams in a mask workpiece of the Fe—Ni alloy, blackening the etched workpiece, stretching the blackened workpiece in two directions or upwardly and downwardly, and then stretching the same on a frame.

7. A color picture tube comprising the semi-tension mask according to claim 6.

* * * * *